US005188135A

United States Patent [19]

Neumann et al.

[11] Patent Number: 5,188,135

[45] Date of Patent: Feb. 23, 1993

[54] METHOD AND APPARATUS FOR PROCESSING SHEET METAL BLANKS AND CONTINUOUS STRIP

[75] Inventors: John W. Neumann; J. Scott Neumann, both of Birmingham, Mich.

[73] Assignee: Neumann Industries, Inc., Madison Heights, Mich.

[21] Appl. No.: 590,558

[22] Filed: Sep. 28, 1990

Related U.S. Application Data

[63] Continuation-in-part of Ser. No. 484,511, Feb. 23, 1990, abandoned.

[51] Int. Cl.[5] ..... B08B 3/02

[52] U.S. Cl. ..... 134/64 R; 134/184; 134/122 R

[58] Field of Search ..... 134/64 R, 61, 63, 122 R, 134/184

[56] References Cited

U.S. PATENT DOCUMENTS

| | | | |
|---|---|---|---|
| 3,743,109 | 5/1973 | Hebner | 134/64 R |
| 3,782,791 | 1/1974 | Neumann et al. | 384/116 |
| 3,957,599 | 5/1976 | Lindsay et al. | 204/269 |
| 4,270,317 | 6/1981 | Kurie | 134/64 R |
| 4,357,196 | 11/1982 | Tanaka et al. | 134/64 R |
| 4,475,259 | 10/1984 | Ishii et al. | 134/64 R |
| 4,788,992 | 12/1988 | Swainbank et al. | 134/64 R |
| 4,928,717 | 5/1990 | Osarek et al. | 134/64 R |

*Primary Examiner*—William A. Cuchlinski, Jr.
*Assistant Examiner*—William C. Dowling
*Attorney, Agent, or Firm*—Lloyd M. Forster

[57] ABSTRACT

Blank washer for cleaning individual sheet metal blanks with a drawing compound liquid suitable for press operations which employs pressurized liquid vortex diffuser means to replace conventional scrubbing brushes. An enclosure with air knives at entrance and exit to the blank washer provides closed loop recirculating of both air and cleaning liquid, which is filtered and repumped to plenum chambers feeding individual vortex diffuser cylindrical outlets which discharge liquid vortexes in close proximity to the passing sheet metal.

55 Claims, 12 Drawing Sheets

FIG. 4
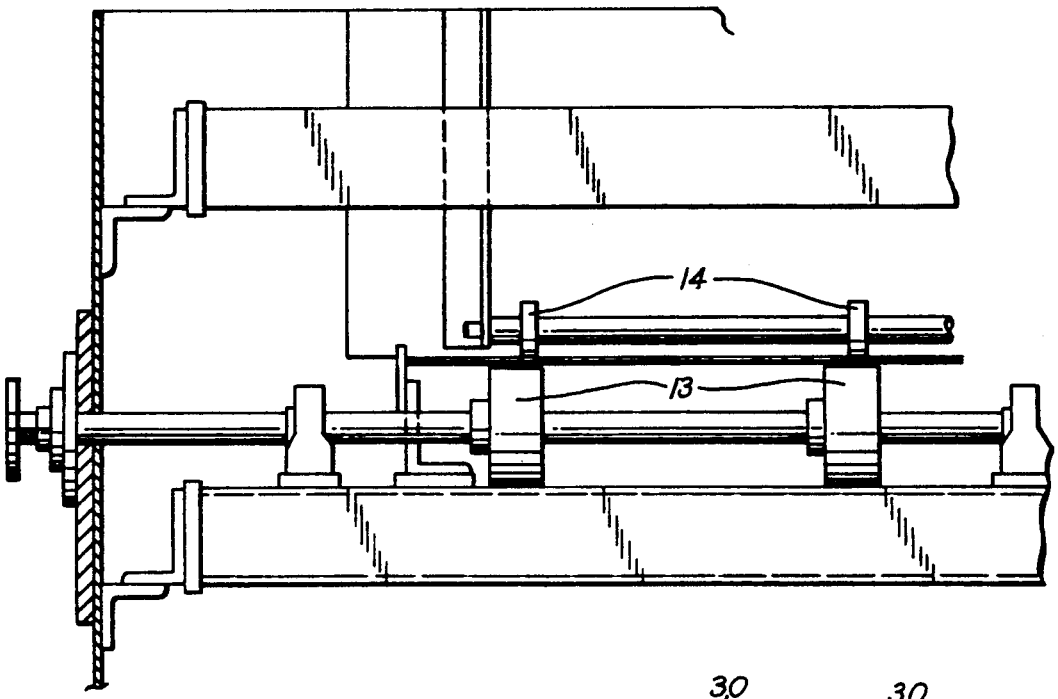
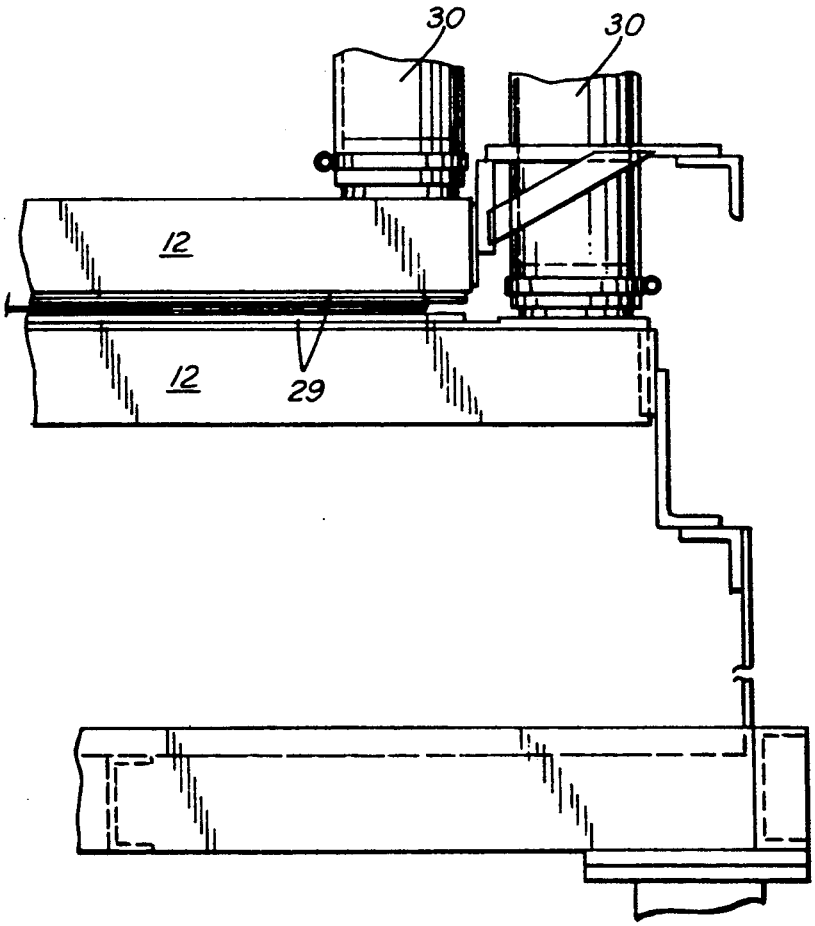
FIG. 5

METHOD AND APPARATUS FOR PROCESSING SHEET METAL BLANKS AND CONTINUOUS STRIP

This application is a continuation-in-part of copending application, Ser. No. 07/484,511, filed on Feb. 23, 1990 now abandoned.

BACKGROUND OF THE INVENTION - BLANK WASHERS

In metal stamping plants, such as engaged in forming body components for the automotive industry, flat sheet metal blanks must be cleaned and treated with a liquid drawing compound preparatory to the forming operations. In conventional practice, a stack of blanks, which may have been sheared or die cut to irregular shapes preparatory to forming, are automatically fed through a washing station in which rotary brushes are supplied through tubular hubs with a fluid cleaning and drawing compound and distributed by the brushes to the passing surfaces of the blank. Wringer rollers are employed to drive the blanks and retain the liquid within the station and meter such liquid for drawing purposes.

Surplus drawing compound flowing off the surface of the blanks is collected in a tank under the brushes and recycled through filters before return to the brushes. Such operations are subject to certain problems: Blank edge engagement of the brush bristles may include irregular burrs tending to cut or pull the bristles loose. They may adhere, on occasion, to the surface of the blanks admitted to the forming press where they may be pressed into the surface creating imperfections, particularly objectionable in light gauge sheet metal of which current automotive bodies are formed. In addition, grit and debris on the blank surfaces accummulated from preceding operations are not always effectively removed by the brush action, particularly as the brushes accumulate deposits picked up from the blank surfaces. Furthermore, the brushes and wringer rollers are subject to rapid wear and attrition involving the expense of frequent shut down and replacement.

BACKGROUND OF THE INVENTION—CONTINUOUS METAL STRIP

Pretreatment processing in a continuous steel strip plating line, e.g., for chrome plating or tin plating, involves removing the soil and preparing the surface in order to assure dependable adherance of the plating. In a typical line processing stages include electrocleaning in an alkaline electrolyte tank; brush scrubbing to remove the loosened soil; in some cases, such as double reduced batch annealed strip steel, a second stage of electrolytic cleaning in an alkaline electrolyte tank, followed by further brush scrubbing; pickling in an acid solution tank; again followed by brush scrubbing before entering an electroplating tank.

In electrocleaning, the current electrolizes the water to form hydrogen gas at the negatively charged cathode and oxygen at the positively charged anode. The large volumes of these gases generate at or near the strip surface provide the mechanical energy for cleaning in the form of bubbles which loosen the surface soil. Dispersion and replenishment of the surface bubbles on passing continuous steel strip enhances the cleaning process which in conventional practice is somewhat curtailed by liquid drag at the boundary layer which tends to carry a layer of bubbles rather than to disperse them. Such boundary layer also unsulates the surface to impede the chemical action of the cleaner. Such drag and the tendency for progressively boundary layer buildup may cause overflowing of a tank which, in some cases, necessitates successive cleaning tanks rather than elongation of a single tank. This in turn requires a brush scrubbing unit after each cleaning tank. Deflection rolls are required for leading the continuous steel strip into and out of the cleaning tanks as well as wringer rolls at the exit to limit cleaning liquid drag out. The potential of surface defects and soil buildup on such rolls provides a maintenance problem for quality control. Likewise, the brush scrubbers and their associated wringer rolls for liquid containment involve serious maintenance problems and frequent expensive brush replacement. In a typical plating line, two days of maintenance including brush replacement may be involved in every week of operation.

In comparison, vortex diffuser substitutions of the present invention overcome certain limitations and defects of conventional cleaning, scrubbing and pickling units. Vortex diffuser prior art includes a fluid bearing device disclosed in U.S. Pat. No. 3,782,791 as a fluid bearing load supporting system having unidirectional and omnidirectional capabilities which embody means for forming one or a plurality of fluid vortices for separating a body from a supporting surface by an intervening cushion of fluid, providing therewith an extremely low coefficient of friction that facilitates a conveyance of the body for the purposes of transportation, processing, treatment and the like. When such device is employed solely for the purposes of conveyance and/or transportation of articles, the fluid substance discharged conventionally comprises air; however, the patent discloses that alternative fluids can be used including liquids and fluid mixtures, and that the use of such alternative fluid substances is desirable when the vortex diffuser fluid bearing device is employed for effecting a simultaneous conveyance and processing of work pieces supported thereby. Also, that such selected treatments can be achieved in a prescribed sequentially-phased manner by changing the type of fluid substance discharged from selected sections of the air rail assembly such that each work piece is subjected to a prescribed treatment during its travel along each section; and by selecting the appropriate gaseous substance, workpieces such as a container can be subjected to treatments including cleaning, etching, conversion coating, surface coating or painting, electrostatic coating applications, electrocoating or painting, heat treating, baking, drying, cooling, quenching, lubricating, etc. . . . However, such suggestion of various potential treatments of discrete work pieces by vortex diffusion by the appropriate gaseous substance has failed to anticipate the present discovery of the application of vortex diffusion of liquids as a substitute for conventional cleaning with brush scrubbing in blank washers; or as a substitute for conventional cleaning, brush scrubbing and pickling operations in a continuous steel strip plating mill, which substitutions have not been discovered, tested and proven viable during approximately fifteen years since the issuance of said prior art patent.

BRIEF DESCRIPTION OF THE PRESENT BLANK WASHER INVENTION

Applicants have found that effective cleaning and coating of the blanks with a liquid drawing compound may be produced by "vortex diffuser" action dispensing with any requirement for brushes or any physical non-fluid contact with the blank surfaces in the vortex diffuser treatment of the blanks. A plurality of vortex diffusers arranged in staggered relation extending from plenums for fluid supply, have cylindrical discharge openings in close proximity to each of the two flat blank surfaces with a planar surrounding surface extending parallel to each blank surface confining outlet passage for the fluid leaving the cylindrical vortex chambers. By staggering adjacent rows of vortex diffuser outlets, full or overlapping coverage of the passing blank surface by opposing cylindrical vortex outlets may be achieved.

An enclosure for the vortex diffuser plenums confines the discharge to a filtering and recirculating system pumped into the plenums. Air knives at either extremity of the enclosure confine the liquid discharged from the vortex diffuser to a tank under the enclosure. An exhaust duct at the top of the enclosure leads to an air/liquid separator from which a blower draws the separated air for return to plenums for the air knives.

Accordingly, a "closed loop" system for both liquid and air is provided to minimize vapor discharge to the surrounding plant.

BRIEF DESCRIPTION OF THE PRESENT CONTINUOUS METAL STRIP INVENTION

Electrolytic alkaline cleaning may be performed, without submersion in a liquid alkaline bath, by passing continuous steel strip between opposed liquid alkaline vortex diffusers in close fractional inch proximity to the strip and including a series of transverse longitudinally spaced vortex rails having alternately oppositely charged metal vortex cups which electrolyze the liquid alkaline vortex discharge to create successive hydrogen and oxygen bubbling at the strip surface with immediate removal by the vortex action. Conductivity in the metal strip between vortex rails completes the electrolytic circuit, as in the case of conventional tank cleaning, with a major difference of continuous bubble dispersion more effectively removing the soil rather than merely loosening it for brush removal as in conventional electrolytic cleaning. Enhanced chemical action at the surface is also realized. Liquid drag at the boundary layers is avoided and liquid containment at the cleaning station is effected by liquid knives directed inwardly at the entrance and exit of enclosures for the cleaning station. Such knives take the place of conventional wringer rolls, which together with deflection rolls have been dispensed with.

In place of conventional brush scrubbers following the conventional cleaning tank, the present invention employs vortex diffuser hot water rinsing to remove any alkaline solution from the strip surface.

Successive pickling and rinse stations are similarly isolated preferably by liquid knives which confine the liquid within the enclosure at each of the individual stations. Air knives or wringer rollers are optionally available for such purpose. Such stations, preferably employ a "Strip Tech Module" which may be the same or similar for all successive stations. Such module has a fixed lower set of vortex rails with manifolds supplied by manifold headers and pumps, together with entrance and exit liquid knives for liquid containment. A hinged top unit of the module contains upper vortex diffuser rails, manifolds and liquid knives supplied by connections with the lower manifold supply which are completed by closing of the upper unit, so as to dispense with any need for flexible hose connections. The upper unit is opened by hydraulic motors adapted to actuate through the hinge opening and closing of the upper unit for strip threading and servicing purposes.

The method and apparatus of the present invention include a sheet feeder for developing the processing parameters for particular metal condition and processing requirements thereby minimizing the need for experimental testing of variables on a complete continuous strip line. Such sheet feeder conveys a single sheet of sample material over a succession of processing stations adapted to selectively clean, rinse, pickle and plate at conveyance speeds equal to and exceeding continuous strip mill speeds. Removal and inspection of each individual piece of sheet metal accommodates advance process testing of such parameters as vortex diffuser to sheet gap; effective relative speeds; effective variations in cleaner liquid chemistry; electrocleaning voltage; vortex diffuser design variations; vortex pressure variations; different soil conditions on metal surface; different pickling solutions; different vortex cup configurations and spacing etc. . . . , in order to both minimize test requirements on a complete line and optimize vortex diffuser results.

In a like manner, an enclosure with a continuous metal belt driven at controlled variable speeds in an enclosure with superimposed vortex diffuser rails supplied with liquid under variable pressure, together with air or liquid knives at the entrance and/or exit of the enclosure accommodates simulation of continuous strip operation for visually observed pretesting of the effective pressure variations, vortex cup design and spacing, gap variations and the like.

BRIEF DESCRIPTION OF THE DRAWINGS

FIG. 4 is a fragmentary sectional view taken along the line 4—4 of FIG. 2;

FIG. 5 is a fragmentary sectional view taken along the line 5—5 of FIG. 2;

DETAILED DESCRIPTION OF THE BLANK WASHER DRAWINGS

Figure 1:
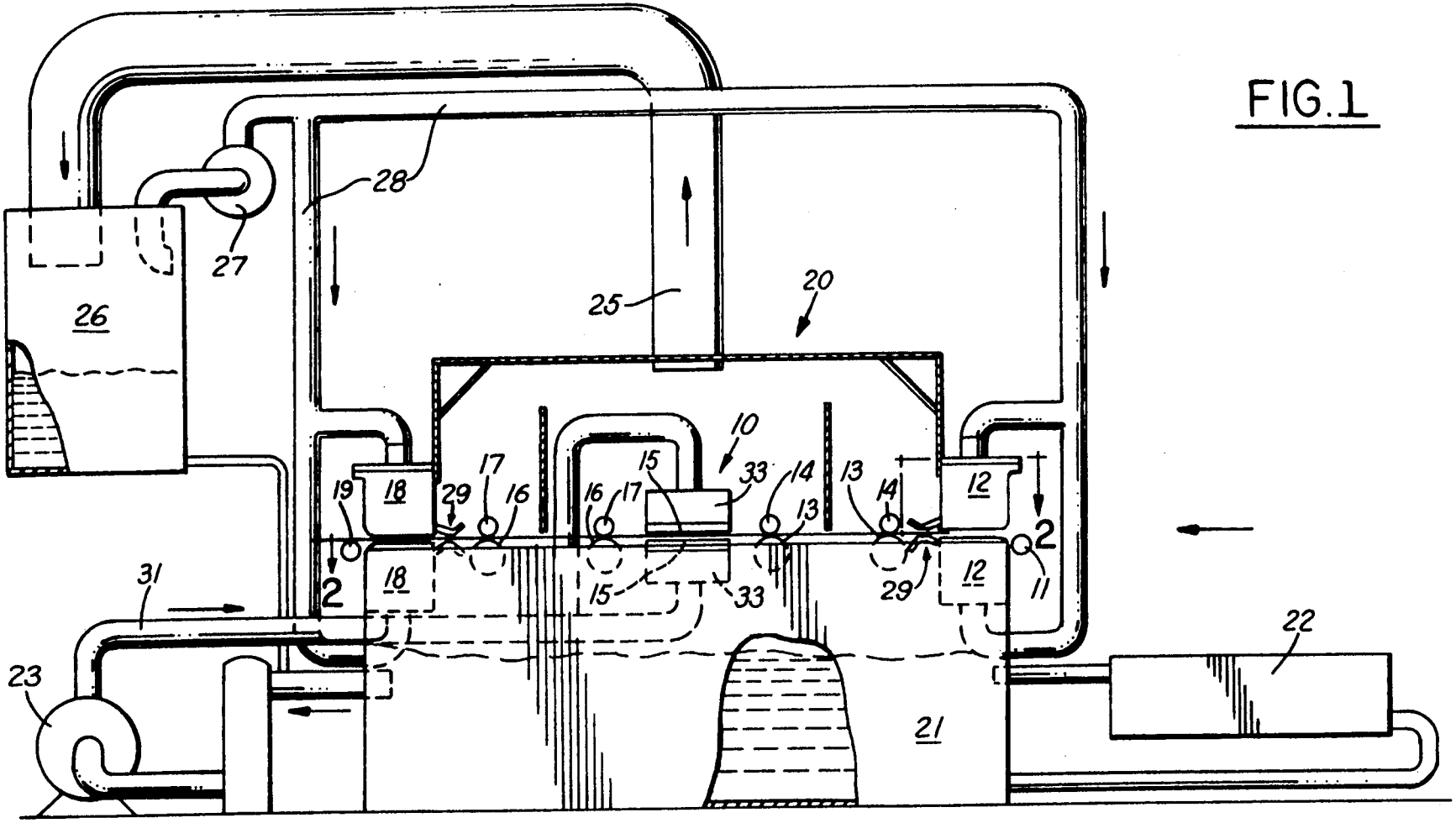
FIG. 1 is a schematic side elevation of a preferred embodiment of the invention.
Figure 2:
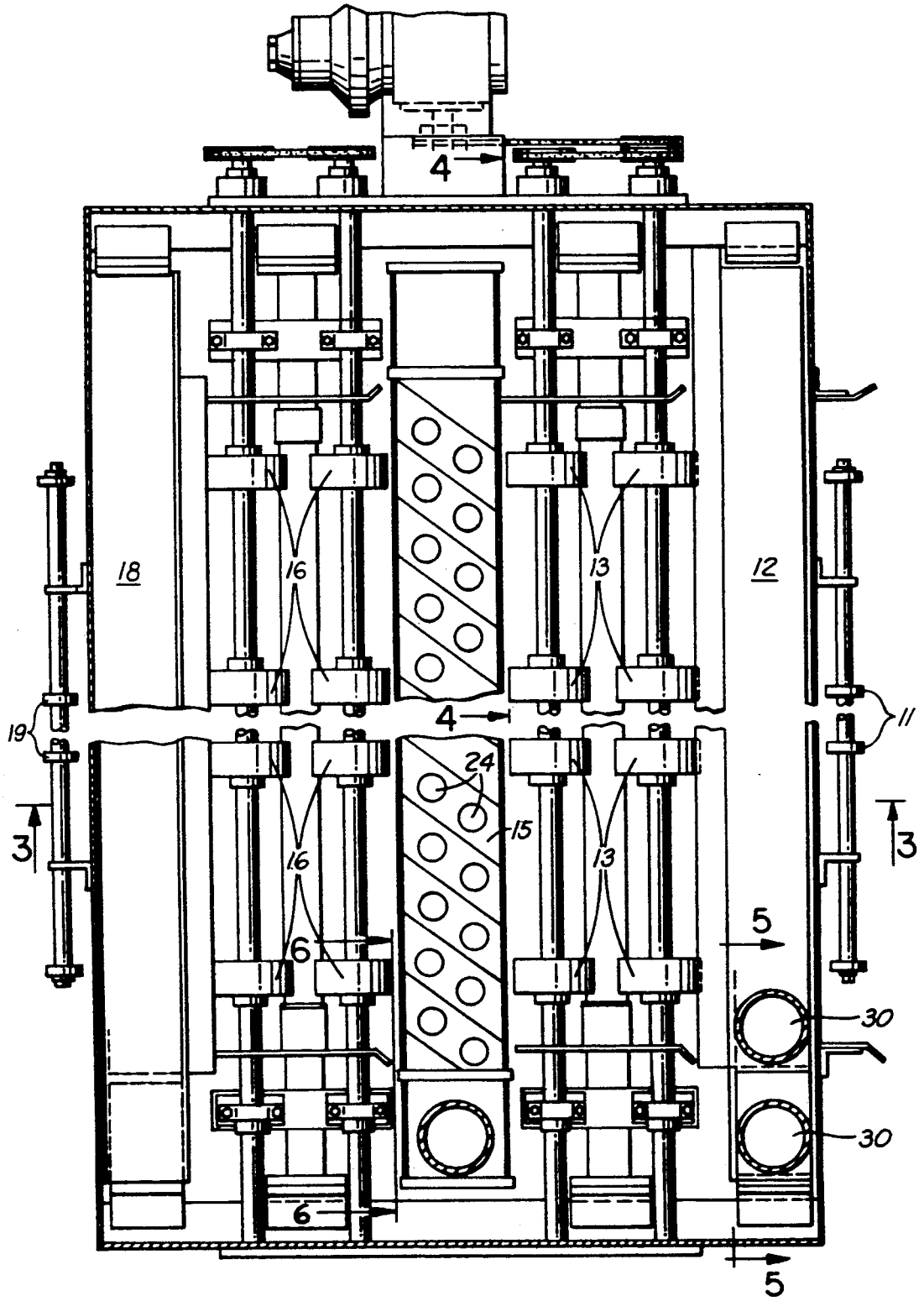
FIG. 2 is a plan view taken along the line 2—2 of FIG. 1.
Figure 3:
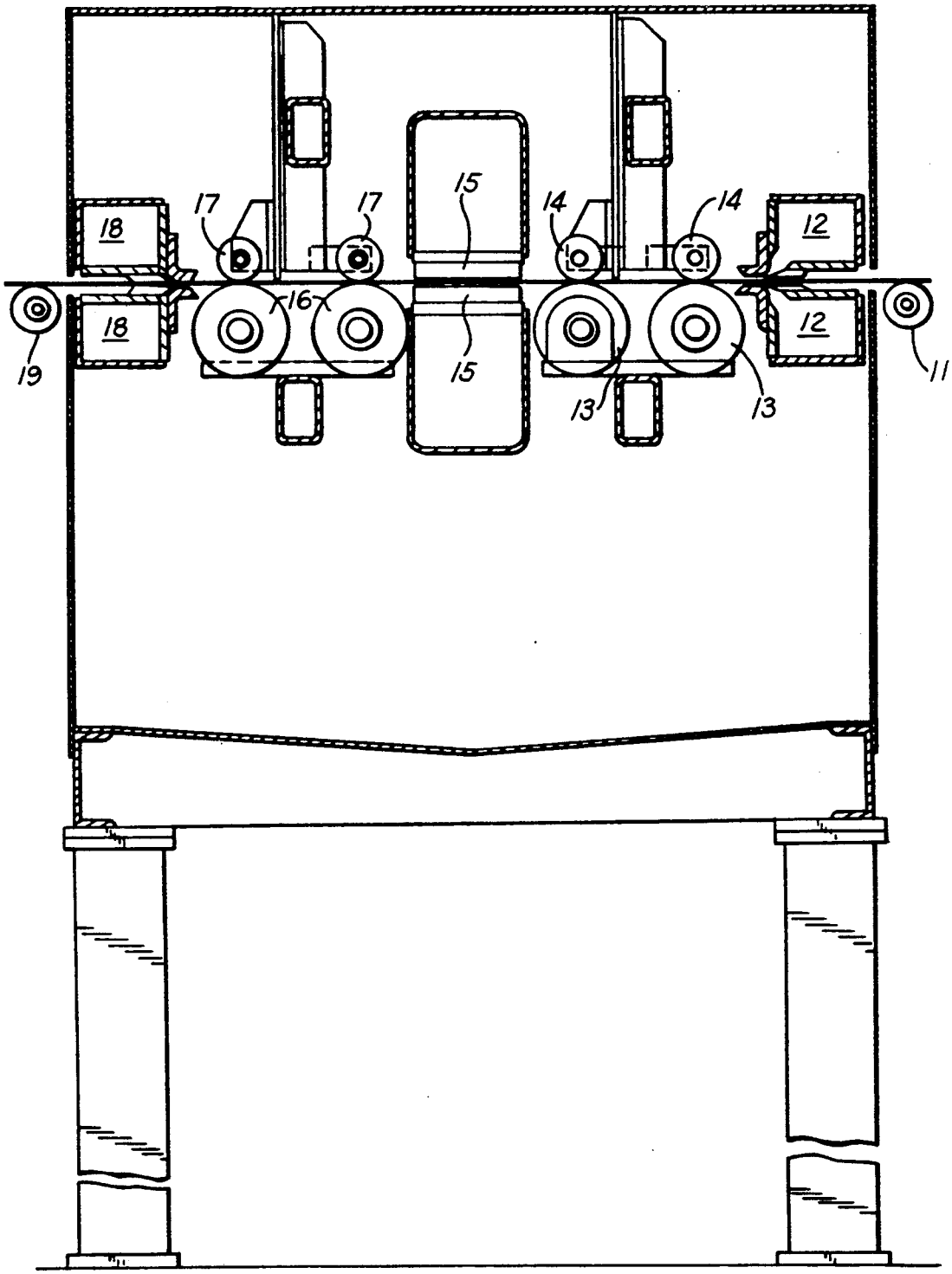
FIG. 3 is a sectional view taken along the line 3—3 of FIG. 2.

With reference to FIGS. 1-3 illustrating a preferred embodiment of the present invention, conventional brushes are replaced by two transverse banks of opposed vortex diffuser units generally indicated at 10. A blank stack and feed system similar to the prior art, feeds individual blanks across entrance guide rolls 11, between a pair of fixed air rail vortex diffuser units 12, across powered feed rollers 13 having pinch rolls 14 above, between opposed vortex diffuser heads 15, past exit drive rolls 16 having pinch rolls 17 above, through a second pair of fixed air knives 18, and past exit guide roll 19.

Enclosure 20 schematically illustrated in FIG. 1 has interior walls which confine liquid cleaning and drawing compound employed in vortex diffusers 10, such as "Parker 410" cleaner/drawing compound mixed with a 9:1 ratio of water, "Parker 101" oil base to prevent rust, or "Quaker 61-MAL-HCL-$N_2$", to drop into tank 21 for return to a filtering and recirculation system 22 such as currently employed in conventional blank washing systems available from the Hyrdromation Company under the trade designation"Hydro Vak". Filtered and recirculated liquid is pumped at 23 into plenums for diffuser heads 15 which extend across the width of vortex diffuser system having constant supply communication with all of the individual vortex diffusers 24.

Air is drawn from the top of enclosure 20 through air duct 25 into an air/liquid separator 26 by recirculating blower 27, distributing the separated air under pressure through manifold pipes 28 to each of the air plenums 12 and 18, where outlet air knives 29 confine liquid from escaping through the blank washer passages and provide cleaned blanks from the exit substantially free of liquid but with a coating of drawing compound as required.

Figure 6:
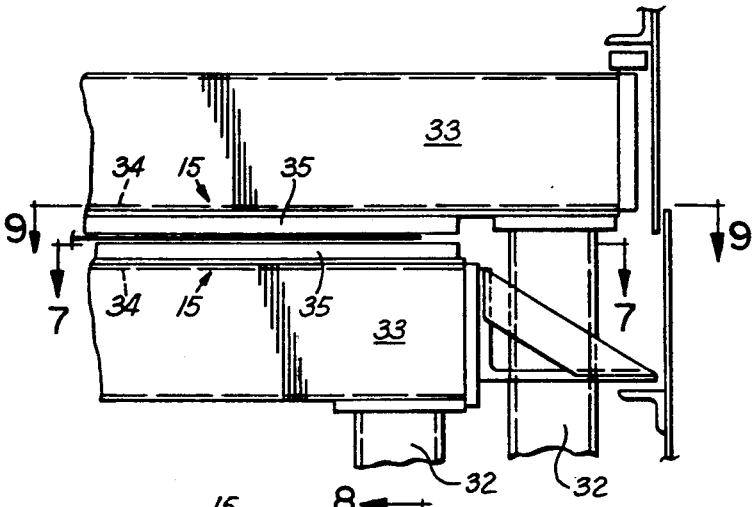
FIG. 6 is a fragmentary sectional view taken along the line 6—6 of FIG. 2.
Figure 7:
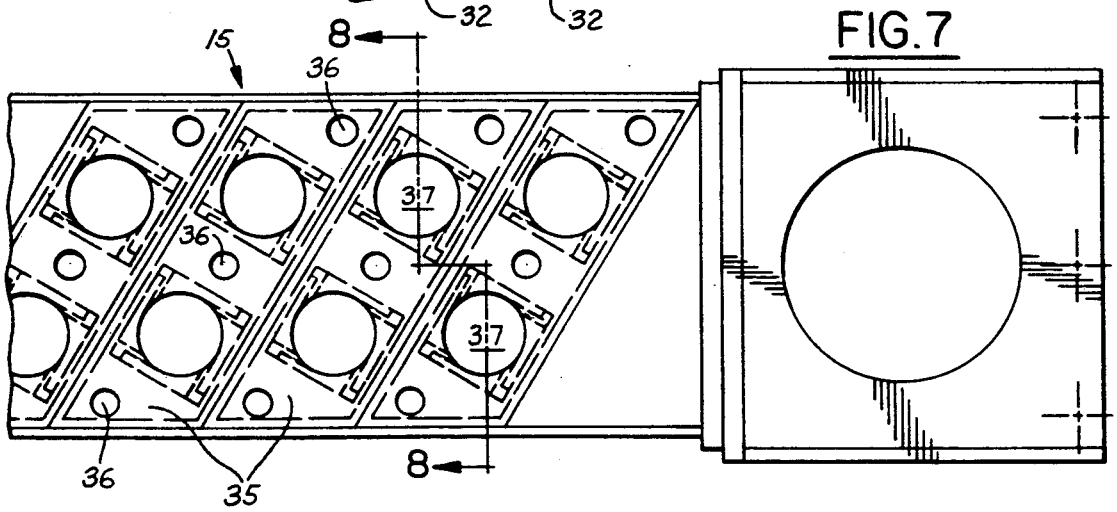
FIG. 7 is a sectional view taken along the lines 7—7 of FIG. 6.
Figure 8:
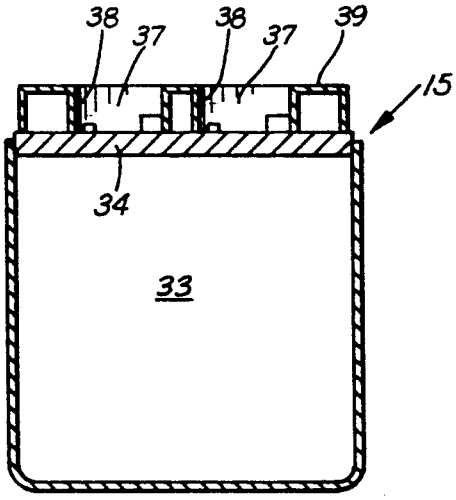
FIG. 8 is a sectional view taken along the line 8—8 of FIG. 7.
Figure 9:
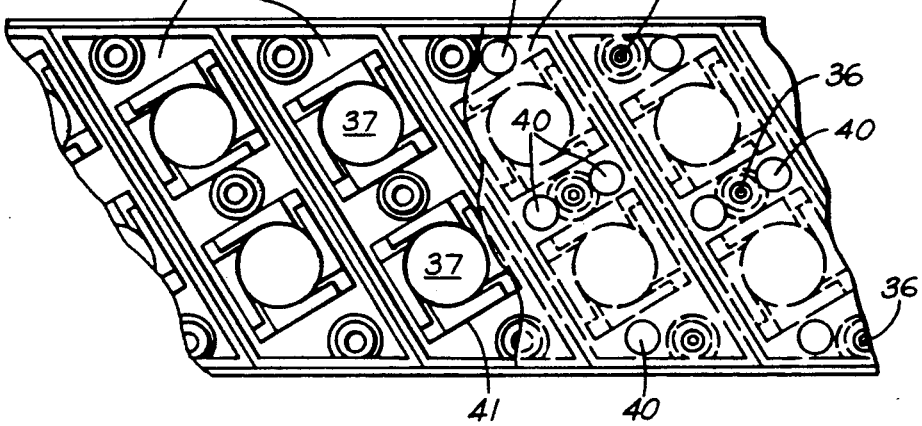
FIG. 9 is a fragmentary sectional view taken along the line 9—9 of FIG. 6.

With reference to FIGS. 2 and 5, recirculating air is supplied to both plenums 12 through descending delivery pipes 30; and with further reference to FIG. 6 recirculated liquid from pump 23 is delivered through pipe 31 leading to ascending outlets 32 and vortex diffuser plenums 15, in each case shown differently in schematic FIG. 1.

With reference to FIGS. 6-11, each vortex diffuser assembly comprises a plenum 33, and vortex diffuser head 15, which has a closure plate 34 covered with a plurality of diagonal nested dual vortex diffuser units 35, each bolted to the cover plate through three holes 36. Each vortex diffuser unit has two circular outlet ports 37 at the terminal end of a right cylindrical wall 38 where the high velocity vortex is generated. Each outlet port 37 terminates in a common plane 39, which is positioned relative to a passing sheet metal blank with approximately ⅛" clearance for both blank surfaces.

Figure 10:
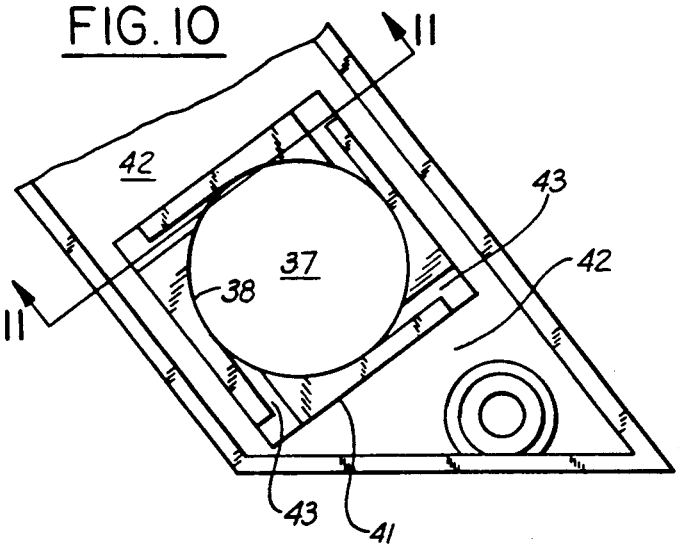
FIG. 10 is a enlarged view of a single vortex diffuser unit such as illustrated in FIG. 9.
Figure 11:
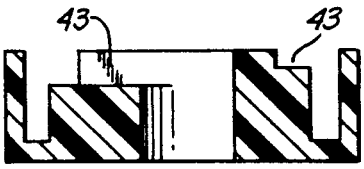
FIG. 11 is a sectional view taken along the line 11—11 of FIG. 10.

For each dual vortex diffuser unit 35, cover plate 34 is provided with four passages 40 for conducting liquid under pressure from the plenum chamber to cavities surrounding square enclosures 41 for each of the two cylindrical walls 38. As best shown in FIG. 10, each square enclosure 41, within cavity 42 is provided with a tangential slot 43 at each of the four corners leading to the periphery of cylindrical wall 38, whereby circular vortexes are generated to impinge on passing blanks.

The staggered relation of the adjacent dual vortex diffuser units provides a tangential relation for full surface coverage of a passing blank in order to effectively clean the entire surface through the vortex action.

In a typical installation, automotive body sheet metal blanks having a thickness of 0.028 to 0.030 of an inch, pass between air knives and vortex diffuser head with ⅛" clearance at both top and bottom surfaces. A width capacity of 84" will accept blanks of any rectangular or irregular configuration with plenums adapted to supply all vortex diffusers regardless of blank size. Adjustable feed speed range, up to 500 feet per minute, will normally be set for intermittent blank feed synchronized with stamping press operation.

Vortex units are provided with liquid pressure in the range of 17-20 psi and air knife plenums with air pressure in the order of 1 psi. A tank for such installation has 850 gallon capacity with 35 gallons per minute passing through the filter. Molded plastic dual vortex diffuser units are made with a material supplied by General Electric under the tradename "Supec", (polyphenylene sulfide) G-401, 40% glass-filled and 1% P-DOX foaming agent.

DETAILED DESCRIPTION OF THE CONTINUOUS METAL STRIP DRAWINGS

Figure 12:
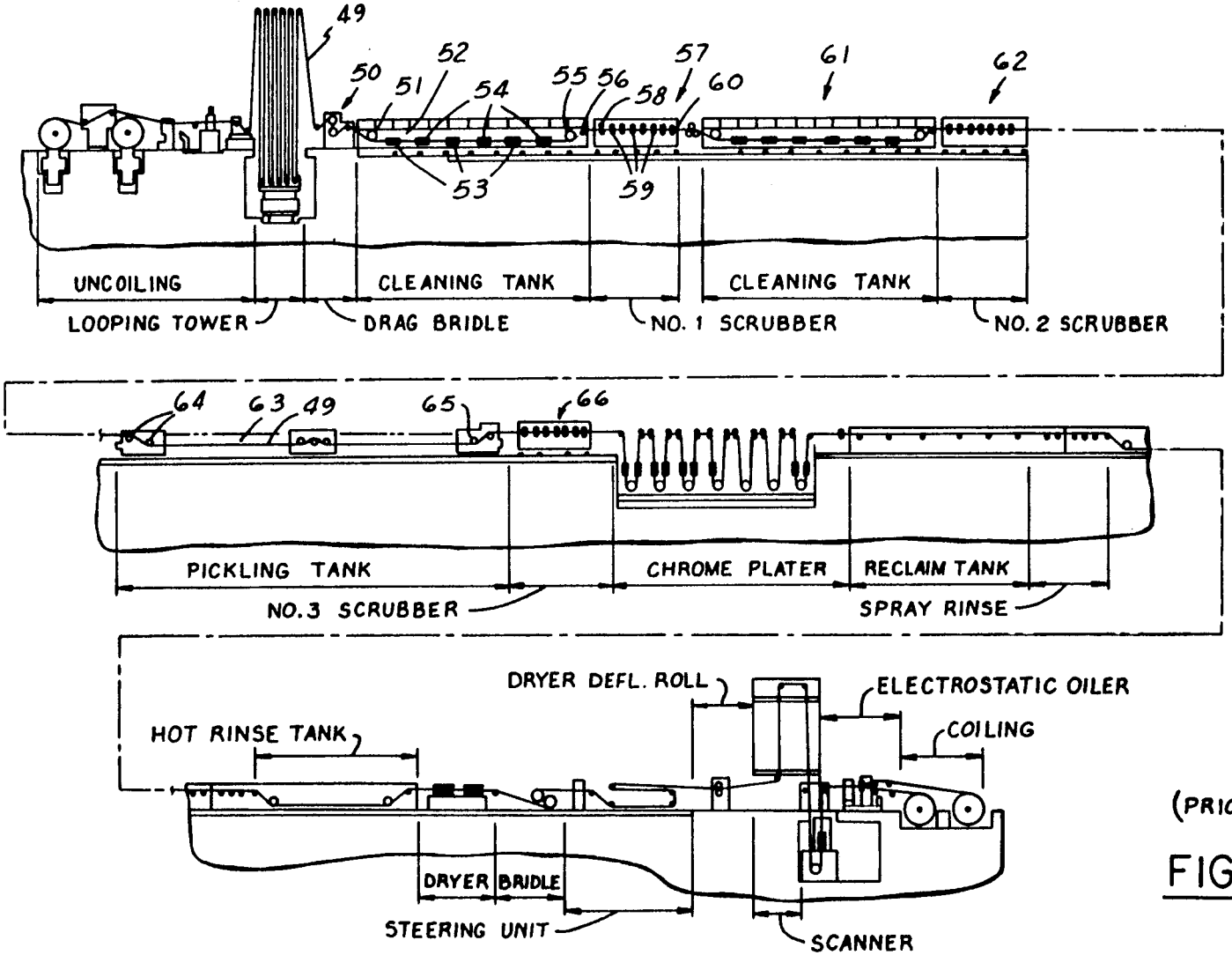
(PRIOR ART) FIG. 12
FIG. 12 is a schematic view of a prior art chrome plating line.

With reference to FIG. 12, a typical prior art chrome plating line is schematically illustrated showing cleaning, scrubber and pickling stations for which vortex diffuser substitutions of the present invention have been developed, tested and successfully reduced to practice. The additional operations performed at the chrome plater, reclaim tank, spray rinse, hot rinse tank, dryer, and electrostatic oiler are believed capable of similar vortex diffuser substitution, e.g., as an extension of the technology described in U.S. Pat. No. 3,957,599, Process for Electrowinning with regard to plating stationary sheet metal. Starting at the left-end of FIG. 12, strip steel 49 from the looping tower is fed through drag bridle rollers 50 and deflection roller 51 into liquid bath 52 of the cleaning tank passing between pairs of alternately charged plus and minus grids 53 and 54 which produce current electrolizing the water in the electrolytic alkaline cleaning liquid to form oxygen at the positively charged anode grids and hydrogen gas at the negatively charged cathode grids, the bubbling of which near the strip surface provides the mechanical energy for cleaning. At the exit of the cleaning tank, deflection roller 55 and wringer rollers 56 lead strip 49 to scrubber unit 57 including a pair of entrance wringer rollers 58, a series of four brush scrubbers 59, alternately upper and lower with backup rollers on the opposite side, and exit wringer rollers 60.

Particularly in the case of a line for double reduced batch annealed steel, a second duplicate cleaning operation 61 and scrubber operation 62 lead to pickling tank 63 where deflection rolls 64 lead strip 49 through a bath of acid pickling liquid with exit deflection rolls 65 leading to a third scrubber unit 66.

In comparison with the conventional prior art line thus far described, and with reference to FIG. 13, the corresponding line incorporating vortex diffuser technology of the present invention includes a series of vortex diffuser stations, each comprising one or more Strip Tech Modules, as later described in detail. Strip 49*a* leaving a conventional looping tower passes horizontally straight through a vortex precleaning heating unit, a series of three Strip Tech Modules 67 serving as a vortex electrolytic cleaner unit; a vortex rinse unit; a vortex pickler unit; a vortex rinse unit; and vortex dryer unit preceeding entrance to a chrome plater.

Figure 14:
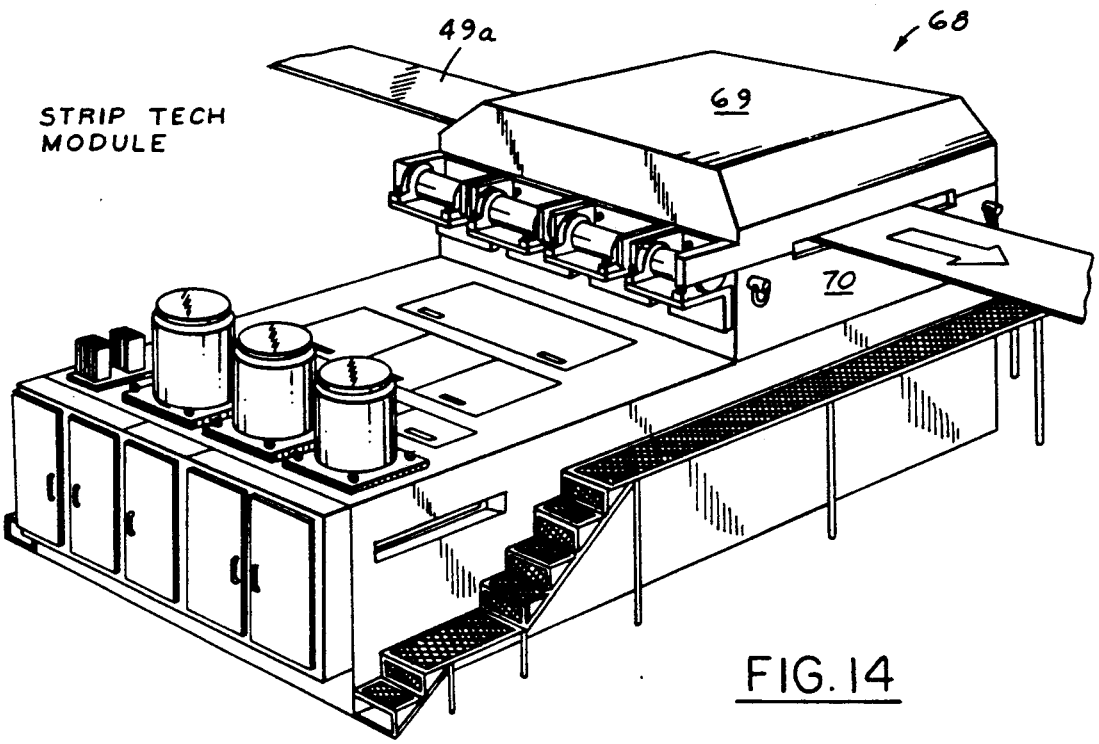
FIG. 14 is a perspective view of a typical vortex diffuser Strip Tech Module with its top section closed.
Figure 15:
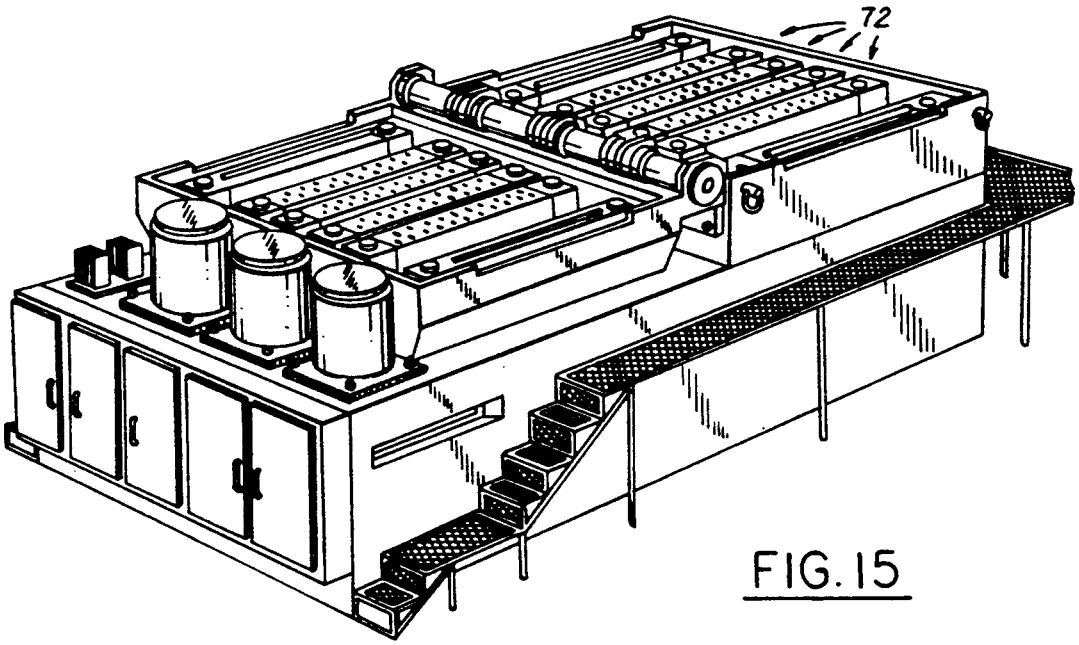
FIG. 15 is a perspective view of the FIG. 14 module with the top section open.
Figure 16:
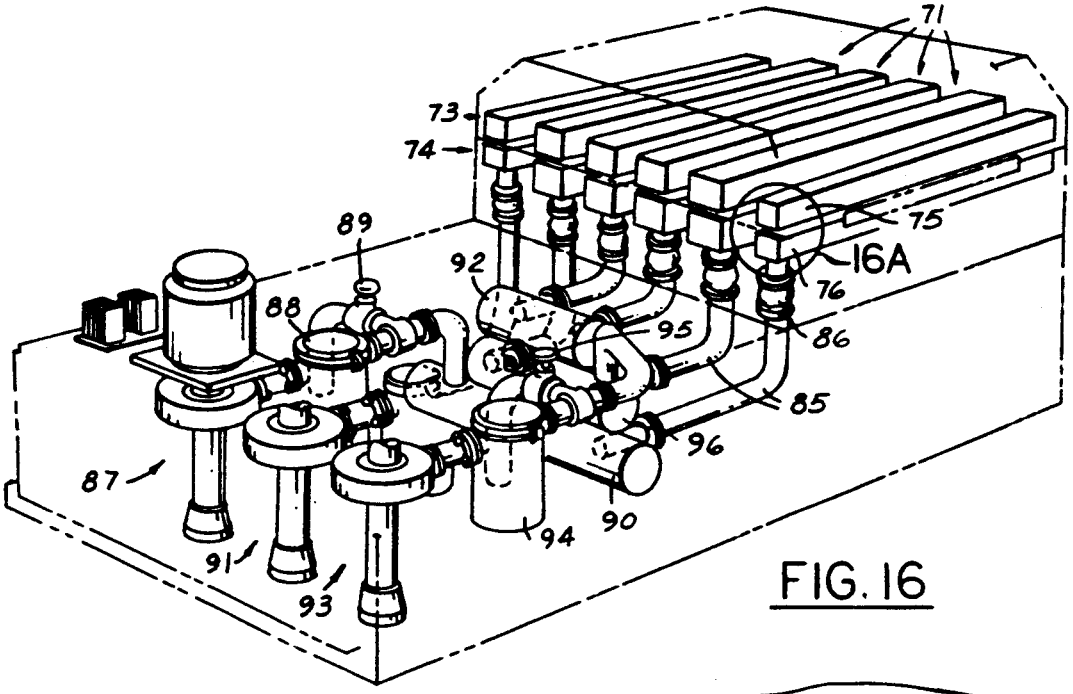
FIG. 16 is a phantom view of the FIG. 14 module illustrating the internal piping.

With reference to FIGS. 14–16, a typical Strip Tech Module is illustrated wherein strip 49*a* passes through vortex diffuser unit 68 comprising upper section 69 and lower section 70 each equipped respectively with four vortex diffuser upper rails, 71 and lower 72; also with an entrance upper liquid knife rail 73 and lower 74, and an upper exit liquid knife rail 75 and lower 76. As illustrated in FIG. 16D, each vortex rail includes liquid plenum 77 feeding a plurality of electrically conductive metal vortex cups 78 seated in metal plate 79 retained by nonconductive cover 80. As shown in FIG. 16C, each liquid knife rail comprises plenum 81 feeding liquid knife slit 82 at the juncture of horizontal plate 83 and adjustable vertical angle plate 84 with the liquid knife exit directed inwardly at both entrance and exit of the module in order to provide liquid containment.

With reference to FIG. 16, six pipe lines 85 provide liquid under pressure through flexible isolators 86 to the six pairs of liquid knife and vortex plenums, which are in turn supplied by three pumps through three filters, three control valves and three manifold headers. Pump 87 supplies both pairs of liquid knives through filter 88, control valve 89 and header 90. The inboard manifolds are supplied by pump 91, filter and control valve not shown, and header 92; and outboard manifolds are supplied by pump 93, filter 94, control valve 95 and header 96.

Figure 16A:
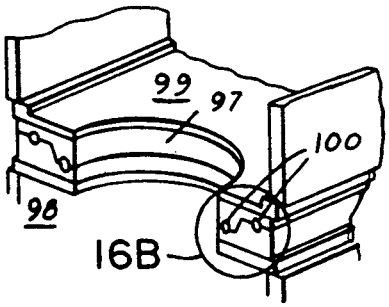
FIG. 16A is an enlarged sectional view illustrating a typical connection between upper and lower vortex or liquid knife manifolds taken through the center line of such connection in an area such as identified by circled FIG. 16A in FIG. 16.
Figure 16B:
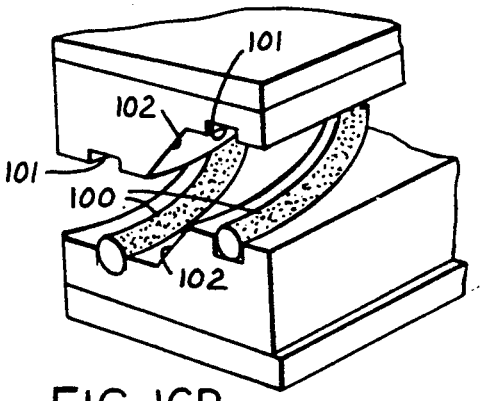
FIG. 16B is a further enlarged fragmentary view of the sectional area identified by circled 16B in FIG. 16A illustrating O-ring seals for providing liquid containment.
Figure 16C:
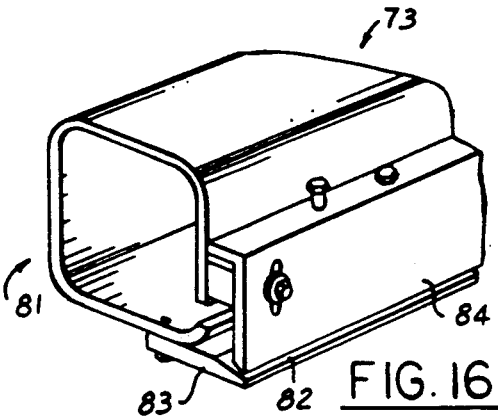
FIG. 16C is a fragmentary sectional view of a typical liquid knife manifold.
Figure 16D:
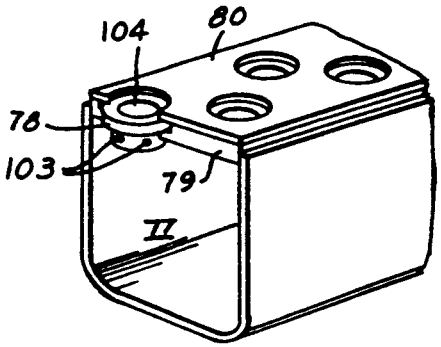
FIG. 16D is a sectional fragmentary view of a typical vortex manifold.

With reference to FIGS. 16A and 16B, each of six supply passages 97 from a lower plenum 98 to an upper plenum 99 is sealed, when upper section 69 is closed over lower section 70, by a pair of O-rings 100 seated in annular grooves 101. Tapered shoulders 102 on inserts secured to the respective plenums serve to assure accurate alignment of each pair of plenums.

Figures 16E, 17:
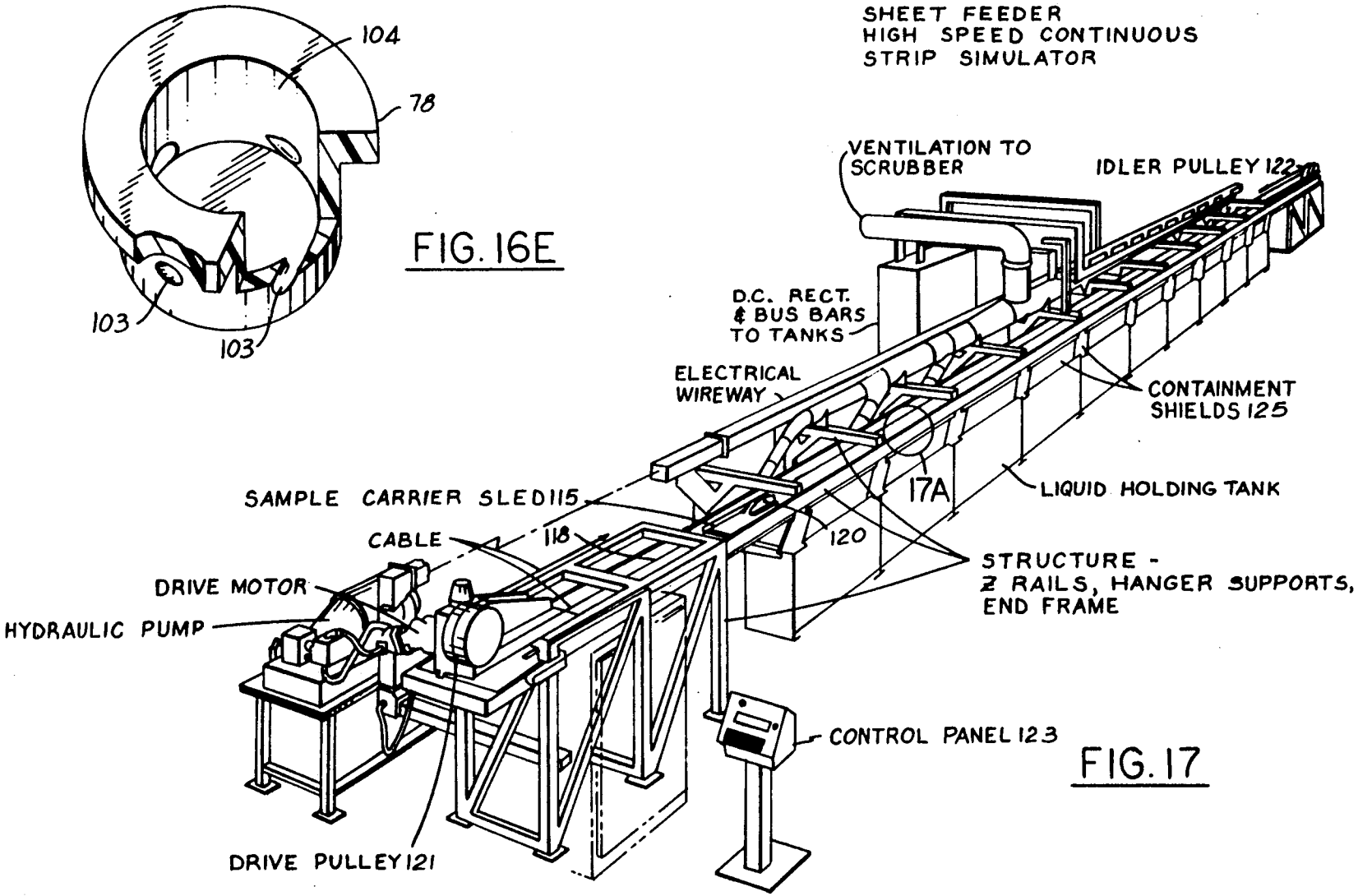
FIG. 16E is an enlarged perspective view of a single vortex cup.
FIG. 17 is a perspective view of a "sheet feeder" high speed continuous strip simulator.

With reference to FIG. 16E, each vortex cup 78 is provided with four inlet holes 103 leading to tangential outlets at the interior perimeter 104 so as to create vortex swirling of the liquid discharged against passing strip 49*a*.

Figure 13:
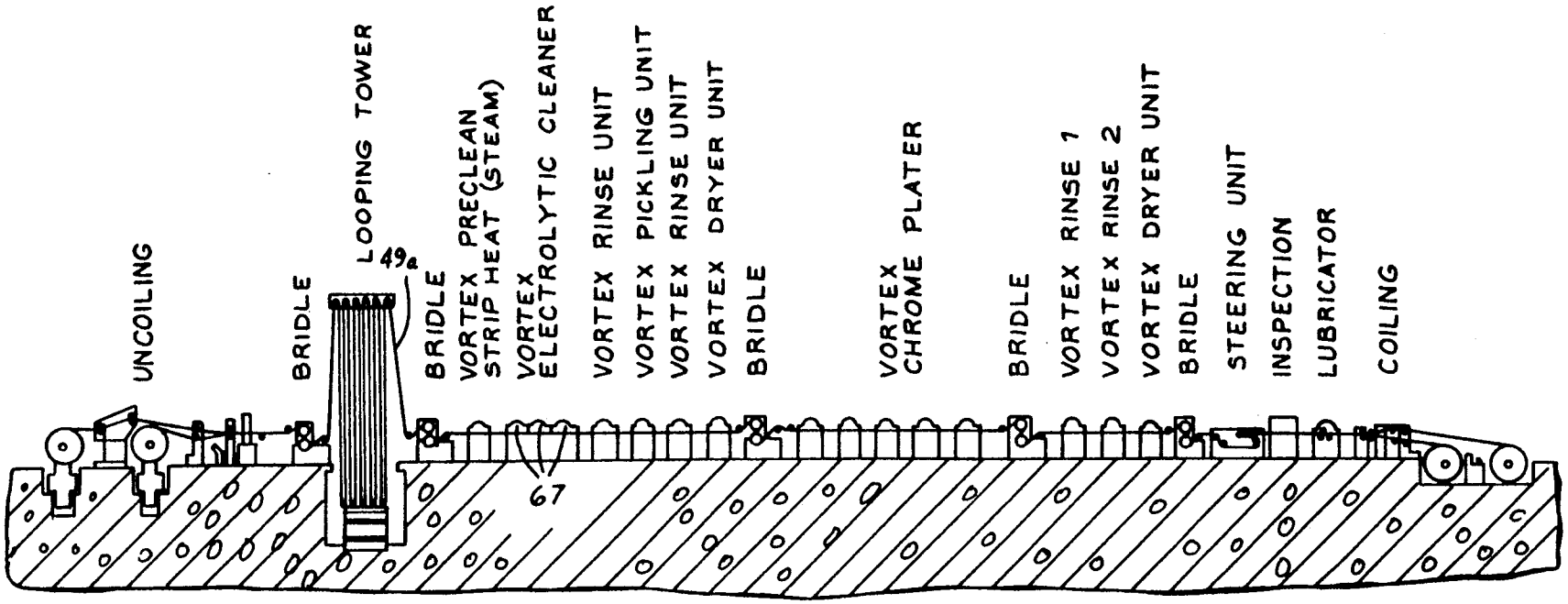
FIG. 13 is a schematic view of a comparable vortex diffuser line.

In the case of the vortex electrolytic cleaner station illustrated schematically in FIG. 13, following the vortex preclean strip heating station, each of the three adjacent modules 67 is provided with electrical connections, not shown, to the respective manifold plates 79 with alternate positive and negative electrical circuits in order to electrolize the water to form hydrogen gas to the negatively charged cathode and oxygen at the positively charged anode. In the vortex rinse, pickling and dryer units, such electrical connections may be omitted, but the modules are otherwise standardized, to provide successive required surface treatment of the passing strip metal.

Reduction to practice in an operating plating mill for strip steel having a thickness of 0.006–0.024" and a width up to 36" traveling at a line speed up to 1850 feet per minute. Successful cleaning, was achieved with a non-foaming alkaline electrolytic liquid in the cleaning station having a trade designation NXP-116 formulated as follows:

NXP-116 CLEANER

| Compound | Parts by Weight |
|---|---|
| Sodium Carbonate | 10.86 |
| Sodium Gluconate | 2.72 |
| Sodium Metasilicate (Pentahydrate) | 40.73 |
| Progasol COG* (Concentrate) | 2.24 |
| Sodium Hydroxide | 43.45 |

*Progasol COG Surfactant – SP Gr 1.030 Obtained from: Lyndal Chemical Co. Dalton, Georgia Three to nine per gallon of water provided a suitable cleaning solution.

Vortex cups having one and one-half inch cylindrical discharge opening were positioned in staggered relation across each rail in contiguous relation relative to area coverage of passing strip surface with a gap spacing in the range of 5/32 to ¾ inch utilizing liquid vortex plenum pressure of 30 psi and liquid knife pressure of 16 psi. With nine ounces per gallon cleaning solution at 180° F. and 50 volts, a current density of 1000 amps/sq. ft was achieved.

The same vortex diffuser configuration and pressures are employed at successive water rinsing and 5% sulfuric acid 140° F. pickling stations.

With further reference to FIG. 13, the illustrated five module vortex chrome plater has not been tested on line to date, but based on an extension of the technology of the vortex Process for Electrowinning disclosed in U.S. Pat. No. 3,957,599 and the aforementioned successful results of vortex diffuser electrolyte cleaning of a moving strip, equally successful plating is foreseen. While such patent is limited in its disclosure to plating on a stationary sheet, which comprises the cathodic portion of a electrolytic couple, applicants believe that effective metal plating may be achieved on a cathodic moving strip using an appropriate electrolyte with electrical contact to the strip. Likewise, it is anticipated that the vortex rinse following plating will be effective for reclaiming the electrolyte solution.

Based on reduction to practice experience for cleaning, scrubbing and pickling stations, and reasonable assumptions for the balance of the line, applicants have determined that comparable metal plating can be effected in approximately one half the length of the FIG. 12 conventional line.

Figure 17A:
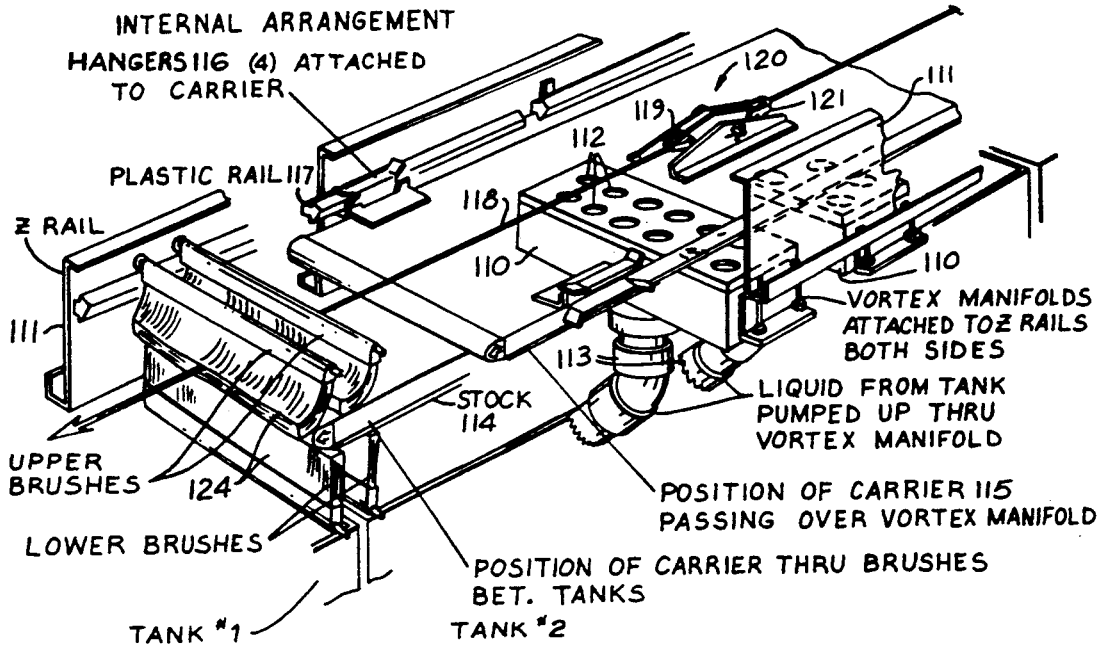
FIG. 17A is an enlarged perspective broken view illustrated the internal arrangement at a typical location such as indicated at A in FIG. 17.

With reference to FIG. 17 and 17A, the sheet feeder high speed continuous strip simulator provides a series of ten separate liquid holding tanks over each of which transverse vortex manifolds 110 are mounted between a pair of Z rails 111 with vortex cups 112 adapted to discharge liquid from each individual tank pumped up through supply lines 113 to overpassing metal sheets 114 on the underside of carrier sled 115 supported by hangers 116 sliding on plastic rails 117 and driven by capable 118 in a forward direction through attachment 119 to carrier bracket 120 and driven in a return direction by attachment 121 at the other end of the cable.

As shown in FIG. 17, the drive cable extends around drive pulley 121 at the forward end of the sheet feeder and idler pulley 122 at the return end with each end on the underside attached to bracket 120. The drive pulley is threaded for helical cable engagement with a sufficient number of wraps on each side of center to equal the total length of the sheet feeder so that when the ends of the cable are attached to bracket 120 under tension, the underside will wind on the drive pulley while the sled advances from the idler end to the drive end and the upper side of the cable unwinds from the drive pulley. Upon reversal of the drive pulley, the sled is returned to the idler end with similar winding of the upper side and unwinding of the lower. In this manner, the hydraulic pump and drive motor are capable of rapidly accelerating the sled before reaching the first tank to a speed as high as 2700 feet per minute, which is in excess of the maximum plating line speeds.

A single steel sheet metal blank is held on the underside of the sled by a magnetic surface material which is adequate to hold it securely in passing over vortex diffusers selectively actuated by control panel 123 to energize individual station pumps, not shown, for individual liquid holding tanks. Sample sheets having typical soil conditions can thereby be passed over cleaning, scrubber, rinsing, pickling, plating and any other optional vortex diffuser processing tanks to simulate, on one side only, the processing typical of both sides in a continuous steel strip plating line.

As best shown in FIG. 17A, containment of liquid between individual tanks is accomplished by upper and lower containment brushes 124 on both sides of the sled, together with fixed containment shields 125, in lieu of exit and entrance liquid knives, preferably employed in the Strip Tech Modules.

Figure 18:
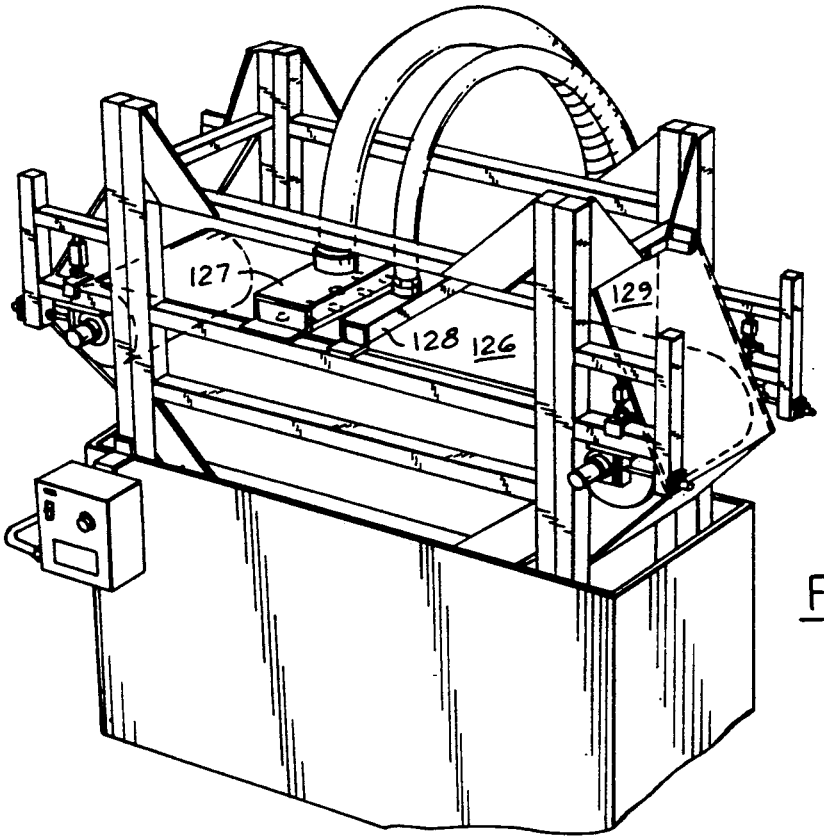
FIG. 18 is a perspective view of an endless sheet metal or plastic belt continuous strip simulator.

With reference to FIG. 18, a moving belt test stand is also employed with a stainless steel or clear plastic endless belt 126 adapted to pass under a vortex manifold 127 and liquid knife 128 within a clear plastic enclosure 129 which enables a viewer to observe the vortex action and liquid knife action in a manner simulating a continuous steel strip plating line.

We claim:

1. A moving sheet metal surface processing station comprising a stationary enclosure with brushless liquid vortex diffuser means, means for moving said sheet metal surface past said vortex diffuser means in adjacent proximity, means for establishing pressurized fluid vortex discharge impingement on said passing sheet metal surface, and means for confining the discharged fluid within said enclosure.

2. Station of claim 1 including an enclosure with entrance and exit for moving sheet metal pass-through, brushless liquid vortex diffuser means disposed within said enclosure with clearance for pressurized liquid vortex discharge impingement on both surfaces of passing sheet metal, and means for confining the liquid within said enclosure from passing out of said entrance and exit, said station serving as substitute means for performing typical surface engaging brush scrubber functions.

3. Station of claim 1 including an electrolytic cleaning liquid vortex diffuser means disposed within said enclosure with atmospheric clearance for vortex liquid discharge impingement on both surfaces of passing sheet metal, said diffuser means including adjacent alternating oppositely electrically charged vortex diffuser outlets linearly spaced along the sheet metal path, said station serving as substitute means for performing typical electrolytic cleaning functions on sheet metal passing submerged through electrolytic cleaning liquid.

4. Station of claim 1 including pickling liquid vortex diffuser means disposed within said enclosure with atmospheric clearance for vortex liquid discharge impingement on both surfaces of passing sheet metal, said station serving as substitute means for performing typical pickling functions on sheet metal passing submerged through pickling liquid.

5. Station of claim 2 wherein said means for confining fluid within said enclosure comprises pressurized fluid knife means directed at both surfaces of said sheet metal inwardly from an extremity of said enclosure.

6. Station of claim 5 wherein said fluid knife means comprises pressurized liquid.

7. Station of claim 1 incorporated in a continuous metal strip surface processing line extending between metal strip coil unwind and wind-up reels with continuous travel of the strip metal through said station.

8. Station of claim 1 including modular vortex diffusion means having upper and lower vortex diffuser sections hinged for opening, and having piping connection means for conducting pressurized liquid between lower and upper sections effected by closing the top section in operating position over the bottom.

9. Station of claim 1 incorporated in surface processing simulation means for testing processing parameters comprising a plurality of said processing stations linearly spaced, each station having vortex diffuser means disposed for upward discharge impingement on the undersurface of overpassing flat metal sheet, a sheet carrier sled and track means for transporting an individual sheet over the vortex diffuser means of said successive stations, a drive means for reciprocating said sled between starting and finishing ends at a start-to-finish speed at least corresponding to continuous metal strip surface processing requirements, whereby individual metal sheets having surface condition corresponding to production sheet metal may be subjected to simulated processing to establish parameters for subsequent implementation on production processing.

10. Station combination of claim 9 wherein reciprocation of said sled is effected by flexible forward and return tow line means coiled on a drive drum at the finishing end with a sufficient number of convolutions to equal at least double the length between said starting and finishing ends and with said tow line extending from said drive drum over a pulley at the starting end and back to said drive drum.

11. Station combination of claim 9 wherein the bottom of said sled is provided with a magnetic surface for retaining a sheet of metal to be processed during transportation of said sled.

12. Station of claim 1 including an endless steel or plastic belt extending with a horizontal surface over drive and idler rollers in said enclosure, including vortex diffuser means disposed above the upper surface of the belt whereby parameters for processing production sheet metal surfaces may be tested.

13. Station of claim 12 wherein said enclosure is constructed with transparent material to provide means for observing operation of said station.

14. Station of claim 1 with vortexes spaced to provide at least substantially contiguous impingement contact path surface coverage.

15. Station of claim 14 wherein said vortexes are spaced laterally and longitudinally in staggered relation relative to the path of said sheet metal.

16. Station of claim 2 including a plenum supply chamber for the vortex diffuser means on each side of said sheet metal.

17. Station of claim 16 wherein said proximity is established by a common planar surface on each side of said sheet metal.

18. Station of claim 17 wherein said vortexes discharge from circular outlets in each planar surface.

19. Station of claim 18 wherein said vortex diffuser means includes a right cylindrical surface leading to each circular outlet.

20. Station of claim 19 wherein tangential porting is provided into said cylindrical surface to generate said vortexes.

21. Station of claim 20 wherein said tangential porting is provided at four 90° spaced corners.

22. Station of claim 20 wherein said cylindrical surfaces are provided in hollow units having said tangential porting molded therein.

23. Station of claim 22 wherein said hollow units are molded plastic.

24. Station of claim 23 wherein said hollow units are molded in obliquely extending dual outlet units stacked laterally across the width of said station.

25. Station of claim 24 wherein a plenum supply chamber is provided for the vortex diffuser means on each side of said sheet metal, and wherein an appertured cover plate is interposed between said plenum supply and said hollow units.

26. Blank washer for cleaning passing sheet metal blanks characterized by means for sequentially feeding individual horizontal blanks between a pair of pressurized liquid vortex diffuser means, said diffuser means being positioned to discharge a plurality of high velocity liquid cleaning vortexes into direct impingement on both passing surfaces of said sheet metal, said vortex diffuser means serving as a brushless substitute means for performing typical surface engaging scrubber functions.

27. Blank washer of claim 2 wherein said vortexes discharge from said vortex diffuser means in approximately ⅛" proximity to each passing surface of said sheet metal.

28. Blank washer of claim 26 including an enclosure for said vortex diffuser means to contain the discharge of liquid flowing off the surface of said sheet metal.

29. Blank washer of claim 28 wherein said enclosure includes a tank under said vortex diffuser means to receive said discharge.

30. Blank washer of claim 29 including filter means for the liquid discharged into the tank.

31. Blank washer of claim 30 including a recirculating pump means for drawing liquid from said tank, and pumping it back into vortex diffuser plenums.

32. Blank washer of claim 31 including a supplemental filter screen for liquid drawn into said pump.

33. Blank washer of claim 28 including air knife means at the entrance and exit of said enclosure directed toward the interior of said enclosure to minimize liquid discharge from the entrance and exit for said sheet metal.

34. Blank washer of claim 33 including a recirculating means for the air directed into said enclosure.

35. Blank washer of claim 34 including an air/liquid separator and a blower means for recirculating separated air to said air knives.

36. Blank washer of claim 33 including plenum means for supplying air to said air knives on either side of said sheet metal at both entrance and exit to said enclosure.

37. Blank washer of claim 33 including a closed loop system for recirculating liquid discharged through said vortex diffuser means and air discharged through said air knife means to restrain both from passing out of said blank washer enclosure.

38. Blank washer of claim 26 wherein said vortex diffuser means is provided with pressurized liquid within a range of approximately 17–20 psi.

39. Blank washer of claim 26 including means for feeding sheet metal at an adjustable linear speed.

40. Blank washer of claim 39 including means for feeding sheet metal at an adjustable linear speed up to 500 feet per minute.

41. Blank washer of claim 35 wherein air pressure is provided by said blower in the order of 1 psi.

42. Vortex diffuser rail means for discharging pressurized vortex fluid onto substantially the entire transverse area of a longitudinal material surface comprising a plenum for conducting pressurized fluid, a plurality of vortex units mounted on an outlet side of said plenum, each unit having fluid inlet and outlet means for creating vortex swirling of fluid discharged onto said surface.

43. Vortex diffuser rail means of claim 42 wherein said units are spaced in staggered contiguous relation to effect swirling fluid discharge over substantially the entire transverse area of said material surface.

44. Vortex diffuser rail means of claim 43 wherein said units are spaced in staggered contiguous relation to effect swirling fluid discharge over substantially the entire longitudinal area of said material surface when moved longitudinally past said rail means.

45. Vortex diffuser rail means of claim 44 including means for discharging pressurized vortex liquid.

46. Vortex diffuser rail means of claim 45 including means for discharging pressurized vortex liquid on both surfaces of passing sheet metal.

47. Apparatus including a stationary enclosure, and including means for brushless processing of sheet metal surfaces passing through a stationary enclosure comprising the impingement of pressurized liquid transversely and longitudinally oriented vortexes discharged in close proximity and substantially total area coverage of both longitudinally passing sheet metal surfaces, and including the confinement of discharged liquid within said enclosure.

48. Apparatus including a stationary enclosure with vortex diffuser means, and including means for brushless processing of sheet metal surfaces passing through a stationary enclosure comprising the impingement of pressurized liquid transversely and longitudinally oriented vortexes discharged in close proximity and substantially total area coverage of both longitudinally passing sheet metal surfaces, and including the confinement of discharged liquid within said enclosure.

49. Method for brushless processing sheet metal surfaces passing through a stationary enclosure comprising the impingement of pressurized liquid transversely and longitudinally oriented vortexes discharged in close proximity and substantially total area coverage of both longitudinally passing sheet metal surfaces, and including the confinement of discharged liquid within said enclosure.

50. Method of claim 49 including the method of brushless washing of sheet metal blanks passing through said enclosure and including the impingement of pressurized washing liquid on said surfaces.

51. Method of 49 for electrolytically processing continuous strip sheet metal passing through said enclosure including the impingement of pressurized electrolyte liquid including the step of oppositely electrically charging adjacent alternating linearly spaced vortexes along the sheet metal path.

52. Method of claim 49 for pickling continuous strip sheet metal passing through an enclosure including the impingement of pressurized pickling liquid on said surfaces.

53. Method of claim 49 including the method of brushless rinsing continuous strip sheet metal passing through said enclosure and including the impingement of pressurized rinsing liquid on said surfaces.

54. Method of 49 for cleaning continuous strip sheet metal passing through said enclosure including the impingement of pressurized electrolyte cleaning liquid including the step of oppositely electrically charging adjacent alternating linearly spaced vortexes along the sheet metal path.

55. Method of claim 49 including the method of brushless scrubbing continuous strip sheet metal passing through said enclosure including the impingement of pressurized scrubbing liquid on said surfaces.

* * * * *